US006039862A

United States Patent [19]

Rapp

[11] Patent Number: 6,039,862

[45] **Date of Patent: *Mar. 21, 2000**

[54] METHOD FEATURING A NON-CONSUMABLE ANODE FOR THE ELECTROWINNING OF ALUMINUM

[75] Inventor: Robert A. Rapp, Columbus, Ohio

[73] Assignee: The Ohio State University, Columbus, Ohio

[ * ] Notice: This patent is subject to a terminal disclaimer.

[21] Appl. No.: 09/339,129

[22] Filed: Jun. 24, 1999

Related U.S. Application Data

[63] Continuation of application No. 08/985,787, Dec. 5, 1997, Pat. No. 5,942,097.

[51] Int. Cl.[7] ..... C25C 3/06

[52] U.S. Cl. ..... 205/386

[58] Field of Search ..... 204/246; 205/372, 205/386, 385

[56] References Cited

U.S. PATENT DOCUMENTS

| | | | |
|---|---|---|---|
| 3,960,678 | 6/1976 | Alder | 204/67 |
| 3,974,046 | 8/1976 | Alder | 204/67 |
| 4,385,970 | 5/1983 | Skopp et al. | 204/108 |
| 4,468,298 | 8/1984 | Byrne et al. | 204/60 |
| 4,468,300 | 8/1984 | Byrne et al. | 204/60 |
| 5,279,715 | 1/1994 | La Camera et al. | 204/64 |
| 5,725,744 | 3/1998 | De Nora et al. | 204/244 |

*Primary Examiner*—Kathryn Gorgos
*Assistant Examiner*—Erica Smith-Hicks
*Attorney, Agent, or Firm*—Standley & Gilcrest LLP

[57] ABSTRACT

The present invention includes a conceptually new process to produce primary aluminum through the modification/adaptation for the HHC of a non-consumable anode of the type used for solid oxide fuel cells (SOFC) with the provision to electrochemically utilize/burn a fuel. The present invention is believed to work most effectively when the dissolution and fragility problems of the zirconia-base solid electrolyte can be sufficiently alleviated, e.g., through the use of a lower electrolysis temperature, through the use of melt additives to restrict dissolution, and/or through modem methods for the fabrication/deposition of the electrolyte onto an appropriate internal metal anode. The present invention thus achieves, through the use of the solid-electrolyte-coated anode, the long-sought non-consumable anode. The electrochemical oxidation, inside the NCA in accordance with the present invention, of an inexpensive fuel, e.g., reformed natural gas (as is done in the modern SOFC), constitutes a significantly more favorable anodic oxidation reaction than the evolution of pure oxygen disclosed by Marincek.

2 Claims, 6 Drawing Sheets

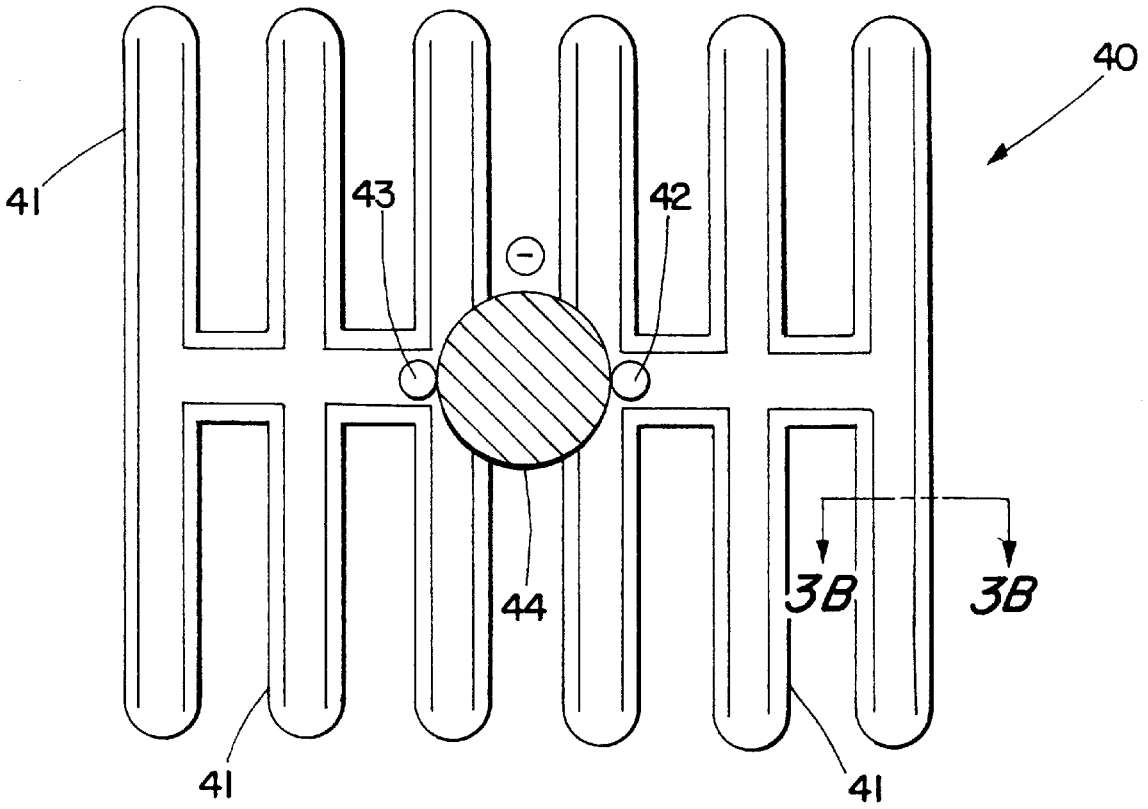
Fig. 3A
Fig. 3B
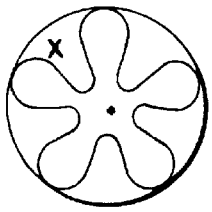

METHOD FEATURING A NON-CONSUMABLE ANODE FOR THE ELECTROWINNING OF ALUMINUM

This application is a continuation of U.S. Application Ser. No. 08/985,787 filed Dec. 5, 1997, now U.S. Pat. No. 5,942,097 incorporated herein by reference.

TECHNICAL FIELD

The present invention is in the field of electrochemical production of aluminum from raw materials.

BACKGROUND OF THE INVENTION

Electrowinning Aluminum in the Hall-Heroult Cell

Since the patenting of the Hall-Heroult cell ("HHC") in 1886 for electrowinning liquid aluminum (Al) at about 960° C. , the basic features have remained the same, although obviously significant optimization of the process variables has occurred. (1) Even today, liquid Al is deposited into a carbon (cathode) hearth, having sidewalls protected by frozen crust, by electrochemically reducing alumina ($Al_2O_3$) dissolved in a fused fluoride electrolyte.

The principal component of the fused electrolyte is cryolite ($Na_3AlF_6$), although the $NaF/AlF_3$ bath ratio has been optimized and other bath additions (e.g., LiF, $CaF_2$, $MgF_2$) have been made. The electrolyte serves as the solvent for alumina derived from bauxite ore, typically purified by the Bayer digestion process. Most important as backdrop for the process improvement disclosed herein, the modern version of the HHC runs the anodic oxidation reaction at an expensive prebaked and refined carbon anode, resulting in the oxidation and consumption of the carbon to release $CO_2$ product gas. The present invention will also apply to the replacement of the older, but still currently used process, involving a Soderberg carbon anode.

As is well understood by the industry worldwide, there are many problems associated with the use of the consumable carbon anode. First, the stoichiometric consumption of the carbon anode, according to the reaction $$\tfrac{1}{2}Al_2O_3+\tfrac{3}{4}C=Al+\tfrac{3}{4}CO_2 \quad (1)$$

represents a significant cost for the carbon, amounting to about 14.4% of the cost of producing primary Al. (2) However, the formation of the $CO_2$ gaseous product from carbon oxidation offers the advantage that the thermodynamic (open-circuit) voltage for Eq. (1) is held down to 1.20 volts; but then the anodic oxidation reaction has a significant overvoltage of about 0.5 volts, while another 0.35 volts are required to pass the high current through the anode. Furthermore, the uneven oxidation of carbon results in a rounding of the originally flat anode geometry which necessitates a significant anode-to-cathode spacing of about 5.0 cm (to avoid shorting) and thereby a significant IR drop (about 1.45 volts) through the electrolyte, requiring periodic anode adjustment. The evolution of $CO_2$ bubbles at the carbon anode also introduces an additional polarization of about 0.30 volts, while some back reaction between the $CO_2$ product and the reduced aluminum lowers the current efficiency for the particular materials and process variables used. Since the electrical cost of the electrolysis process is directly proportional to both the applied cell voltage and the current efficiency, the elimination, or minimization, of certain of these contributions to the cell voltage could lead to a significant reduction in the cost of producing primary aluminum, as will be demonstrated later.

As an additional important factor opposing the continued use of the carbon anode, the release of the greenhouse gas $CO_2$ by the process is meeting increasing environmental objection. While the stoichiometric requirement for anode carbon according to Eq. (1) is 0.33 #C/#Al, in fact, direct oxidation and other losses result in the consumption of about 0.45 #C/#Al, amounting to the release of 1.65 #$CO_2$/#Al. (2–5) Further, from an environmental standpoint, in addition to $CO_2$, the fabrication and oxidation of carbon anodes also evolve objectionable HF, CO, perfluocarbon volatiles, and other volatile organic compounds (VOC). (5) The equipment and associated maintenance and labor to reduce these emissions inherent to the use of the carbon anode represent a significant cost and problem for the primary aluminum producers.

Through Faraday's Law, the rate of Al production is established (for 100% current efficiency) by the cell current. But a significant cost of electrical energy is required for electrowinning Al. The current US composite baseline energy use is estimated to be 15.2 kWh/kg Al. About 22.8% of the total cost is proportional to the impressed cell voltage which constitutes the summation of the thermodynamic (open-circuit) voltage, the anodic and cathodic overpotentials, bubble effects, the IR drop in the fused salt electrolyte, plus voltage drops in the electrodes and collector bars external to the cell, etc. (4)

The modern HHC operates today at about 4.4 volts with a current efficiency of about 95%. The heat balance for the cell is maintained by providing sufficient insulation so that the $I^2R$ heat generated in the electrolyte keeps the cell at the operating temperature of about 960° C.

The maximum permissible anodic current density, which limits the rate of Al production, is set by the occurrence of the "Anode Effect." When the local concentration of alumina dissolved in the electrolyte becomes too low, $CO_2$ evolution at the anode is interrupted, a passivating/insulating film of very environmentally objectionable fluorocarbon ($CF_4$ and $C_2F_6$) species cover the anode, and the cell must receive immediate attention (i.e., in order to force alumina replenishment to the electrolyte) to resume production. Of course, the Anode Effect cannot be blamed solely on the nature of the anodic oxidation reaction on carbon, but also on the difficulty to dissolve sufficient alumina rapidly enough to support the anode reaction.

The Non-Consumable Anode

Because of the many problems inherent to the carbon anode (high anodic overvoltage, production-limiting current density, high IR drop, objectionable environmental impact, and high cost), researchers dating back to Charles Martin Hall in 1880's have tried to develop a non-consumable (inert) anode ("NCA") comprising an alloy, oxide or a metal/oxide cermet with an oxidized surface where pure oxygen could be evolved as the anodic oxidation reaction to accomplish the following total cell reaction:

$$\tfrac{1}{2}Al_2O_3=Al+\tfrac{3}{4}O_2 \quad (2)$$

While the thermodynamic (open-circuit) voltage of 2.20 volts for reaction (2) using an NCA is higher than the 1.20 volts for reaction (1), the anodic overvoltage amounts to only about 0.10 volts, i.e. much less than the 0.50 volts for the carbon anode. Because of the dimensional stability of an NCA, the anode-to cathode spacing (ACS) could be reduced from about 5.0 cm for carbon to about 3.5 cm for the NCA, with a corresponding decrease in IR drop, and other smaller reductions in required cell voltage would be realized. On the balance, the electrical cost of Al production using the NCA, with no other improvements, should be somewhat less that for a consumable carbon anode. (6) Besides, the significant cost for the carbon anode would be saved and the environmentally objectionable $CO_2$ and other product gases would be replaced by $O_2$. Despite these potential advantages and significant research and development efforts, an acceptable NCA has not yet been inserted into the HHC. The status and development of the NCA were reviewed recently by Thornstad and Olsen. (8) The leading NCA candidate is comprised of the oxides of Fe and Ni, with some copper metal to increase the conductivity. Fine oxygen bubbles are formed at the oxide surface of this "inert" anode contacting the cryolite bath. But the solubilities of NiO and $NiFe_2O_4$ in the electrolyte at normal HHC temperatures are too high, so that unacceptable levels of Ni and Fe impurities are deposited into the Al. However, modifications in the electrolyte composition, e.g. additions of $AlF_3$ and LiF, and the use of a controlled gas evolution to maintain cryolite/alumina slurry, would permit a significantly lower temperature (as low as 685° C. ) for operation of the electrolysis cell and therewith lower solubilities for the offending Ni and Fe solutes. (5, 9) On the whole, an effective NCA would displace the carbon anodes, and existing Al electrowinning cells would be retrofitted with the new NCA. (6)

In a parallel effort to lower the voltage required for the HHC, research into the identification and development of an "inert cathode" is also well established. The high magnetic fields developed during electrolysis induce convection currents in the Al pad, producing an uneven, wavy surface facing the anode. To avoid shorting, the anode-cathode distance ("ACD") must be increased, corresponding to an increased IR drop in the cell, compared to that ACD permitted if the cathode surface were fixed and stable. Inert cathodes are known which contact, but project above the Al pad into the electrolyte, so that the liquid Al deposited at the inert cathode drains into the Al pad below. The leading material candidates involve a $TiB_2$ plus graphite composite, or a $TiB_2$ coating of graphite. However, because of fabrication difficulties and inherently inadequate mechanical properties, the inert cathode has also not been substituted into industrial practice.

The Solid Electrolyte Non-Consumable Anode

In U.S. Pat. Nos. 3,562,135 and 3,692,645, Marincek proposed to electrolyze alumina dissolved in the fused cryolite-base electrolyte by separating the anode from the salt by a thin dense layer of an oxygen-ion conducting solid electrolyte. The zirconia layer (stabilized by calcium oxide or other oxides) would support the electrically driven migration of oxide ions from the melt being electrolyzed, but would be non-permeable to and resistant to the melt at the temperature of electrolysis. At a catalytic, electronically conducting, porous anode inside the hollow structure, pure oxygen gas would be evolved from the electrochemical oxidation of the oxide ions migrating in the solid electrolyte. In principle, the pure oxygen evolved could be collected and sold or used elsewhere in the plant.

These patents by Marincek have not led to a commercial acceptance of this concept, although the scheme achieves essentially the net result (evolution of pure oxygen) as the non-consumable anode under development today. In fact, at the 960° C. normal operating temperature of the HHC, the solubility of zirconia in the cryolite-base melt is quite high about 0.4 and 0.8 wt % Zr for melts containing 6.5 and 2.5 wt % dissolved $Al_2O_3$, respectively.(7) But the solubility drops significantly with reduction in temperature, and new technology is available to run a HHC at significantly lower temperature. Furthermore, zirconia is one of the few oxides that does not react with $AlF_3$ to form $ZrF_4$ and $Al_2O_3$, and has a decomposition potential approximately equal to $Al_2O_3$.

SUMMARY OF THE INVENTION

The present invention includes a conceptually new process to produce primary aluminum through the modification/adaptation for the HHC of a non-consumable anode of the type used for solid oxide fuel cells (SOFC) with the provision to electrochemically utilize/burn a fuel. The present invention is believed to work most effectively when the dissolution and fragility problems of the zirconia-base solid electrolyte can be sufficiently alleviated, e.g., through the use of a lower electrolysis temperature, through the use of melt additives to restrict dissolution, and/or through modern methods for the fabrication/deposition of the electrolyte onto an appropriate internal metal anode. The present invention thus achieves, through the use of the solid-electrolyte-coated anode, the long-sought non-consumable anode. The electrochemical oxidation, inside the NCA in accordance with the present invention, of an inexpensive fuel, e.g., reformed natural gas (as is done in the modern SOFC), constitutes a significantly more favorable anodic oxidation reaction than the evolution of pure oxygen disclosed by Marincek.

The present invention avoids the problems which prevented the use of the dense solid electrolyte anode layer 25 years ago, i.e., high electrolyte solubility, difficult anode fabrication, and inherent fragility, through use of recently developed advanced technology in the fabrication and operation of a solid-electrolyte fuel cell (SOFC), and new methods to reduce the operating temperature of the HHC.

In broadest terms, the present invention comprises an apparatus for producing aluminum metal from alumina, the apparatus comprising: (a) a cathodic molten aluminum bath; (b) a cryolite-based electrolyte fused salt bath in contact with the cathodic molten aluminum bath, the cryolite-based electrolyte fused salt bath being supplied with a source of alumina; (c) at least one non-consumable anode in contact with the cryolite-based electrolyte fused salt bath, the at least one non-consumable anode being internally supplied with a combustible fuel adapted to be electrochemically combusted; and (d) a source of electric current, the current adapted to flow from the cathodic molten aluminum bath to the at least one non-consumable anode. The non-consumable anode(s) may be in the form of a plurality of non-consumable anodes. For instance, the non-consumable anode(s) may be in the form of a plurality of planar members adapted to conduct a flow of the combustible fuel, or in the form of a plurality of tubular members adapted to conduct a flow of the combustible fuel.

Optionally, the apparatus of the present invention may include at least one non-consumable cathode in contact with the cathodic molten aluminum, preferably in such instance, a plurality of non-consumable cathodes in contact with the cathodic molten aluminum.

The non-consumable anode(s) may be of any appropriate material considering the electronic and electrochemical function it is to perform in the subject electrochemical reaction. It is preferred that the non-consumable anode(s) comprise an electronically conducting electroactive material (such as nickel or any other suitable material) disposed on a material capable of conducting predominantly oxygen anions such as a zirconia-based solid electrolyte. It may be preferred that the zirconia-based solid electrolyte bear a ceria-based coating. Accordingly, the present invention optionally includes a mixed-conducting $CeO_2$-base electrolyte coating on the zirconia that provides further protection from dissolution into the cryolite-base melt. Thus, the use of a dense oxygen-ion conducting solid electrolyte as an anode coating is possible under revised HHC operating conditions, and an important and favorable new operational option to electrochemically utilize/burn a fuel comprises part of the invention disclosed here.

The source of electric current adapted to flow from the cathodic molten aluminum bath to the non-consumable anode(s) may be any source, such as those commonly used in known HHC processes, and applied and controlled with known apparatus and methods applied in such processes.

In most general terms, the present invention includes a method of producing aluminum from alumina wherein the electrochemical energy to effectuate such conversion is derived from a combination of current flow and the in situ electrohemical burning of a combustible fuel.

The combustible fuel that may be used in accordance with the present invention may be any fuel capable of undergoing electrohemical burning, such as gaseous fuels, and preferably reformed natural gas.

The present invention also includes, in broadest terms, a method of depositing aluminum metal into a molten aluminum bath from dissolved alumina through the use of a combustible fuel and an electric current, the method comprising electrochemically combusting the combustible fuel at an NCA so as to produce a flow of oxygen ions from the dissolved alumina while additionally causing the electric current to flow from the molten aluminum bath to the NCA, so as to produce aluminum from the alumina.

The present invention also includes, in general terms, a method of producing aluminum metal from alumina, the method comprising the steps of: (1) providing an apparatus comprising: (a) a cathodic molten aluminum bath; (b) a cryolite-based fused salt electrolyte bath in contact with the cathodic molten aluminum bath, the cryolite-based electrolyte fused salt bath being supplied with a source of alumina; (c) at least one non-consumable anode in contact with the cryolite-based electrolyte fused salt bath, the at least one non-consumable anode being internally supplied with a combustible fuel adapted to be electrochemically combusted; and (d) a source of electric current, the current adapted to flow from the cathodic molten aluminum bath to the at least one non-consumable anode; and (2) causing the combustible fuel to be electrochemically combusted and causing the current to flow from the cathodic molten aluminum bath to the at least one non-consumable anode so as to produce aluminum from the alumina.

The method of the present invention may use the apparatus of the present invention as described in its many embodiments as described herein.

It is preferred that the method of the present invention utilize at least one non-consumable anode which is an electronically conducting electroactive material disposed on a zirconia-based solid electrolyte bearing a ceria-based coating, and wherein the method is carried out at a temperature less than about 850 degrees Centigrade.

It will be apparent to one of ordinary skill in the art to produce and use components of appropriate size, geometry and thickness, from the understanding of the electrochemical reactions occurring and the electrical and thermodynamic requirements of standard HHC arrangements, and those of SOFC-type fuel cells. Accordingly, the present invention in broadest terms is not limited to size, geometry and thickness, or to the overall scale of the reactor apparatus.

BRIEF DESCRIPTION OF THE DRAWINGS

FIG. 2(A) is a top plan view and FIG. 2(B) is an elevational front schematic.

FIG. 3A is a schematic drawing of a SOFC-type NCA shown in an alternative tubular geometry, in accordance with still another embodiment of the invention, as adapted for use in an HHC in a horizontal orientation.

FIG. 3B also contains a detail of a cross-section taken along line A—A of FIG. 3A.

DETAILED DESCRIPTION OF THE PREFERRED EMBODIMENTS

In accordance with the foregoing summary of the invention, the following describes preferred embodiments of the present invention which are presently considered to be the best mode of the invention.

Figure 1:
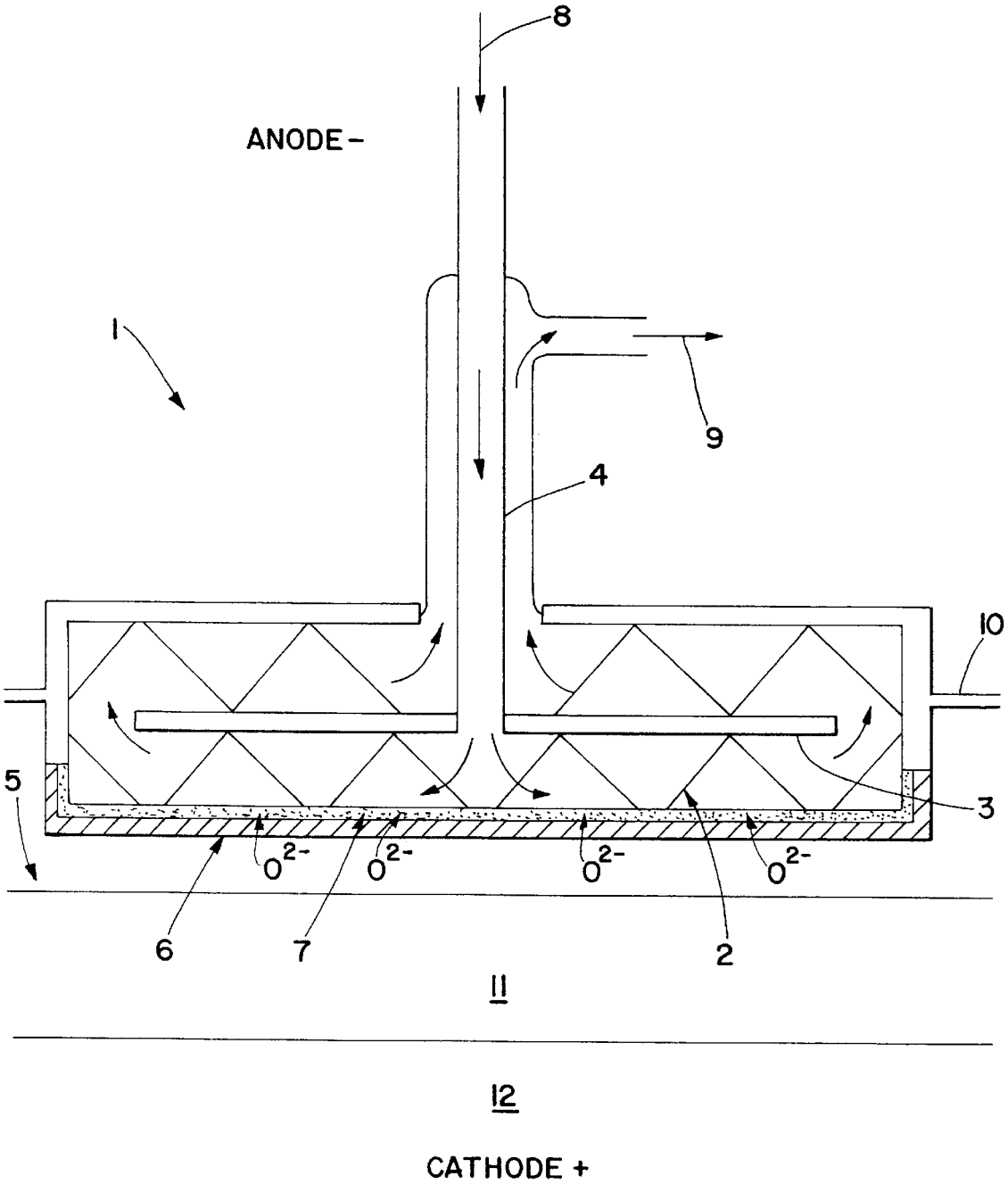
FIG. 1 is a schematic drawing of a SOFC-type NCA shown in a planar geometry, in accordance with one embodiment of the invention, as adapted for use in an HHC in a horizontal orientation.

FIG. 1 shows schematically a SOFC-type NCA 1 of planar geometry, analogous in geometry and placement, but not dimensions, to the carbon anode in an HHC as presently known. The thickness of such a planar SOFC-type anode may be on the order of an inch or less, which would represent little mechanical load to be supported. The corrugated current collector 2 conducts the electrons evolved from the electrochemical oxidation to the mechanical support 3 which connects to the anode collector bar 4. For this NCA, the cryolite electrolyte 5 is isolated from the interior of the anode by the dense solid electrolyte layer 6. For this reason, the formation of HF gas upon reaction of the fuel with cryolite is not possible. Those parts of the NCA in contact with the cryolite-base melt but not coated with zirconia would be protected by an insulating coating resistant to the melt. Oxygen dissolved in the cryolite would pass as oxide ions (in response to a gradient in electrochemical potential through the solid oxide electrolyte) and be electrochemically reduced as the fuel is utilized/burned inside the electrode, according to reactions which can be represented as follows:

$$H_2(g)+O^{2-}(ZrO_2)=H_2O\ (g)+2\ e-(\text{anode}) \tag{3}$$

and $$CO(g)+O_{2-}(ZrO_2)=CO_2+2\ e-(\text{anode}) \tag{4}$$

These are the reactions which occur at a porous anode 7 (preferably Ni) with very little polarization (7–15 mv at about 0.45 A/cm$^2$ current density at 1000° C. ) in the modern SOFC. For operation at 1000° C., a modern SOFC generates approximately one volt at open-circuit for the combustion of reformed natural gas fuel versus an air oxidant at the cathode. This voltage will vary depending upon the exact composition of the fuel supplied to the operation. But the one-volt reduction in open-circuit electrolysis voltage provides an advantage in voltage similar to that provided by the carbon anode reacting according to Eq. (1). Thus, the one-volt lost by the evolution of oxygen at a NCA according to Eq. (2) and as disclosed by Marincek (10, 11) is regained by burning a fuel. Likewise, the selection, resistance and polarization of electronically conducting materials for the internal components in the environment of the NCA shown in FIG. 1 pose fewer problems than for an environment of pure oxygen.

As is illustrated in FIG. 1 and as is common to the other schematic drawings presented below, the fuel gas 8 may be delivered and passed through the interior of the NCA, so that no bubbling would occur in the melt for the electrochemical oxidation of the fuel. In the absence of bubbling, the dimensionally stable NCA permits a minimal anode to cathode spacing (ACS), with corresponding reductions in the IR drop and the $I^2R$ heating of the bath. On the other hand, the solid electrolyte will introduce some IR drop, which will depend upon its composition, thickness and the operating temperature. A fraction of the product gas 9 exiting the NCA can be recycled in a reaction to reform the hydrocarbon fuel, and any residual CO(g) in the rejected product gas is oxidized to $CO_2$(g). At the intended application temperature, internal reforming of the fuel, e.g. natural gas, can be achieved. The composition of natural gas is variable and complex, but in the United States, it can be 95% $CH_4$. Internal reforming of the $CH_4$ forms the reactive $H_2$ (g) and CO(g) molecules. So the net electrolysis reaction could be represented as:

$$4Al_2O_3+3\ CH_4(g)=8Al+3CO_2(g)+6H_2O(g) \quad (5)$$

If supply, cost, or other factors should make alternative fuels such as ethanol more favorable than natural gas, they could also be easily reformed and burned as the fuel. Compared to the use of the HHC carbon anode in Eq. (1), the generation of the environmentally troublesome $CO_2$ gas evolved by Eq. (5) at this NCA would be cut by two-thirds, and no objectionable perfluorocarbons, HF, or VOC gases would be formed, either in the fabrication or in the use of this NCA. In the absence of any bubbling, the cathode to anode spacing could be reduced to achieve a minimal IR drop in the cryolite electrolyte, and the current efficiency should be improved because the reaction of reduced Al with $CO_2$ bubbles cannot occur. The reduction in $I^2R$ heating would be compensated in part by the heat released upon the exothermic oxidation of the fuel.

FIG. 1 also shows the $Al_2O_3$ feed 10 that provides the cryolite bath with a supply of alumina as is known from present HHC arrangements. The cryolite bath 5 resides over aluminum pad 11, supported by carbon hearth 12, which accepts the reduced molten aluminum, also in accordance with known HHC arrangements. The aluminum pad 11 is cathodic and is supplied with a source of current to drive the electrochemical reaction forward.

For the modern SOFC, it is preferred that the solid electrolyte be the oxygen-ion-conducting yttria-stabilized zirconia (YSZ). However, it is understood that oxide additions different from yttria, e.g. calcia-magnesis, etc., also form zirconia-base electrolytes. In its current state, to stabilize the electrode against particle "ripening", the porous Ni electrode is formed by sintering a Ni/YSZ slurry.

The anodic current density required by the HHA cell (about 0.74 A/$cm^2$) can be achieved by the SOFC anode of the present invention with low polarization. Such current density for today's HHC is the same magnitude which is common for the typical SOFC burning of reformed natural gas versus air at 1000° C. Generally, about 70% or more of fuel is utilized (burned electrochemically) for optimum SOFC operation, and the Ni anode remains noble over this regime of gas composition. Polarization of the SOFC's oxide cathode (of no interest here) is more severe than the minor anodic polarization of the porous nickel anode. In earlier SOFC development, to mechanically stabilize the YSZ electrolyte, it was formed by "electrochemical vapor deposition" to fill the continuous voids in a strong, porous zirconia body which mechanically supported the cell. More recently, a thin YSZ electrolyte of only 20 to 40 $\mu$m thickness is deposited by one of several methods onto a strong air cathode tube made of doped $LaMnO_3$. This arrangement is the reverse of the one needed for the HHA modification, which needs a porous Ni anode inside the zirconia electrolyte. Cells are also/usually operated at pressures exceeding one atmosphere pressure (up to 15 atm) to increase the cell voltage. Accordingly, a very highly developed and sophisticated technology for the SOFC anodes exists today, in both the tubular and plate geometries.

While the $H_2O$-rich product offgas from the NCA of FIG. 1 would be less harmful to the environment, the cost of the natural gas (which could be reformed internally at such a hot temperature) would be much less than the corresponding cost of prebaked carbon anodes. As will be described below, the electrical cost to produce Al should also be lower than for today's HHC practice using carbon anodes, and lower than the cost projected for any other NCA process under development. As another unique and favorable aspect of the SOFC-type NCA, there can be no "anode effect" or anode-cathode shorting of the sort experienced by today's HHC. Of course, a materials problem is present for this NCA since all oxides, including the usual SOFC components $ZrO_2$ and $Y_2O_3$, CaO, or MgO, have some solubilities in the cryolite bath. The dissolution of the electrolyte may be minimized by reduction in the normal HHC temperature and by electrolyte additives, e.g. $CaF_2$ or $MgF_2$. Additionally, the external zirconia electrolyte surface could be protected by a coating of a mixed-conducting ceria-base electrolyte which has a lower solubility in the cryolite-base melt.

It is important to note that a SOFC-type NCA of the present invention may be retrofitted into existing HHC plants, thus taking advantage of the huge investment in existing capital equipment currently in use.

Alternative SOFC-Type NCA Arrangements

In the case that the lateral dimensions of the planar SOFC-type NCA illustrated in FIG. 1 were too large, and in the absence of bubble formation in the cryolite melt, the transport of dissolved oxygen, by convection and diffusion in the cryolite-base electrolyte might become inadequate to support the required cell current density. In that case, the zirconia-base electrolyte would become locally reduced and develop a significant n-type partial electronic conductivity which would reduce the current efficiency and perhaps damage the electrolyte. Therefore, in such cases, tubes or other geometries of the SOFC-type NCA may be more advantageous for contacting the oxygen-rich cryolite, and perhaps easier to fabricate.

For these reasons, a tubular arrangement may be preferred for the SOFC-type anode. Schematic drawings of two different possible tubular assemblies are presented as FIGS. 2 and 3. In each case, the external surface is a dense oxygen-ion-conducting solid electrolyte with low solubility in the cryolite, while inside the tube(s) a porous Ni deposit serves as the catalytic anode material.

Figure 2A:
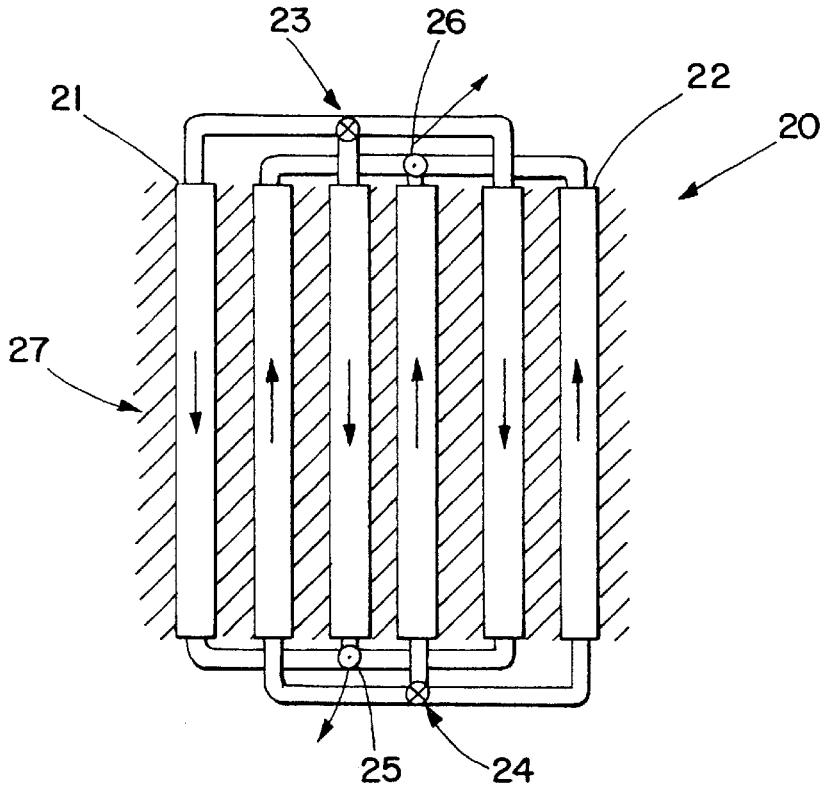
FIGS. 2A and 2B are schematic drawings of a SOFC-type NCA shown in a tubular geometry, in accordance with another embodiment of the invention, as adapted for use in an HHC in a horizontal orientation.
Figure 2B:
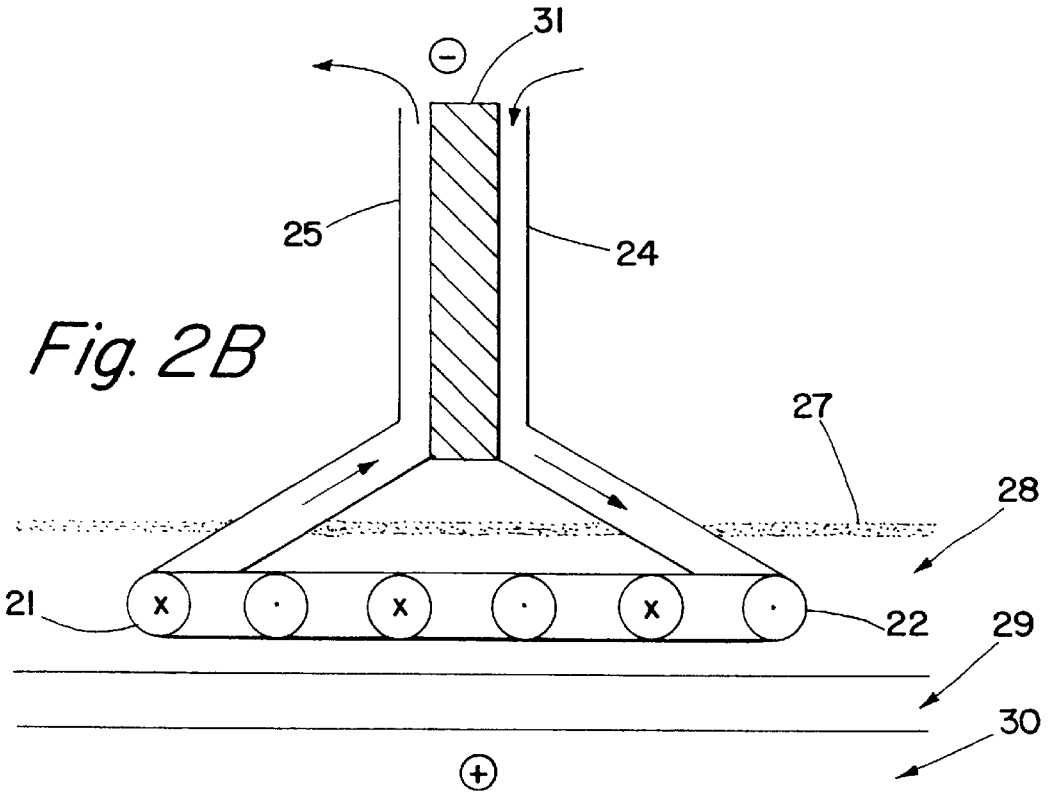

FIG. 2A illustrates from a top view the providing of the fuel gas and extracting of the product gases (from above) from an alternative electrode 20. FIG. 2A shows two series of manifold tubes 21 and 22 each supplied with an input of fuel gas 23 and 24 respectively, and each having a product gas outlet 25 and 26 respectively. This anode arrangement allows for a continuous flow of fuel gas which is provided with oxygen anions by the $Al_2O_3$ feed 27. These manifolds would also support the structure mechanically, and the entire structure is connected to an anode collector bar to extract the electrons from the anode. FIG. 2B illustrates from a front view the immersion of the tubular array shown in FIG. 2A into the cryolite-base melt above the Al pad. FIG. 2B shows the manifold tubes 21 and 22, and the fuel gas input 24 and product gas outlet 25 (fuel gas input 23 and product gas outlet 26 not visible). FIG. 2B also shows the electrode positioned in the cryolite bath 28 (provided with the $Al_2O_3$ feed 27) disposed over aluminum pad 29 and carbon hearth 30. Also shown in FIG. 2B is anode busbar 31 adapted to carry current from the electrode 20.

The arrangement of FIG. 3 shows alternative anode 40 comprising tubes 41 with one end closed where fuel is fed from fuel inlet 42 internally through a corrugated current collector annulus, and the product gases are formed and exhausted on the outside of the current collector to product gas outlet 43. Again, the anode collector bar 44 and the manifolds for provision of fuel and extraction of product gases from above are common features. FIG. 3 also includes an inset showing an optional cross-section taken along line A—A. The arrangement of FIG. 3 may also be immersed into the cryolite-base melt and manifolded in a similar manner to that shown in FIG. 2B. In the arrangement of FIG. 3, the mechanical support for each tube may be provided by the corrugated current collector. Current SOFCs use closed-end tubes that are 2.2 cm in diameter, with the nickel anode on the outside of the solid (yttria-stabilized zirconia) electrolyte. There should be no real problem to reverse this geometry for application in the present invention, and the standard tube size as commercially produced seems to be appropriate. Care should be taken in the fabrication of any segmented structure requiring good seals for high temperatures. However, pin-hole-size leaks in the anode assembly would not seem to introduce any dire consequences.

Either of these two tubular arrangements of FIGS. 2 and 3 may be immersed in the cryolite bath, and positioned immediately above the Al pad. The ACD may be controlled continuously (typically and preferably at about 2 cm or less) to supply the needed cell current and the required heat balance. An effective inert cathode may be used, and may be even contoured, to match the anode to reduce further the ACD. Such a SOFC-type NCA may be covered/fed with alumina powder, and the immediate availability of this feed to the anode typically will be adequate to supply the cryolite bath with sufficient dissolved oxygen, and keep the solubility of the solid electrolyte at a minimum. In fact, such tubular arrangements seem to have every advantage over the planar anode first presented as FIG. 1, including a minimum of surface contacting the melt that is not covered with zirconia.

In this regard, it should be noted that SOFC-type NCAs may be made of any appropriate geometry, and can be custom fabricated to order.

Figure 4:
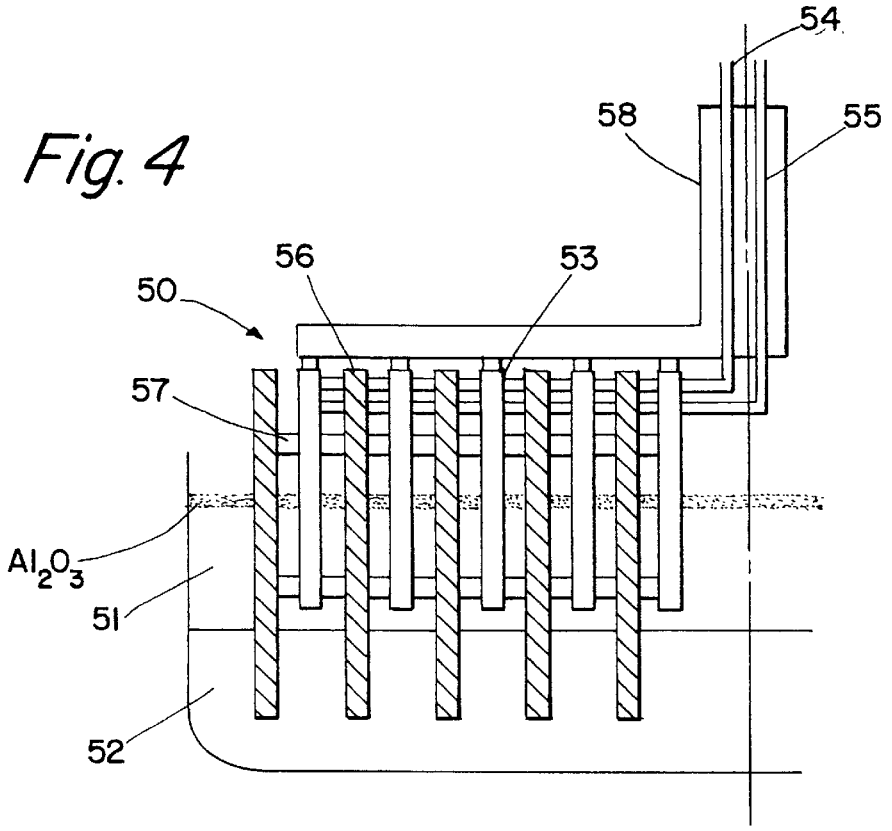
FIGS. 4,4A and 4B are schematic drawings of planar SOFC-type NCAs and inert cathodes, in accordance with still another embodiment of the invention, as adapted for use in an interleaved vertical electrode array in an HHC.
Figure 4A:
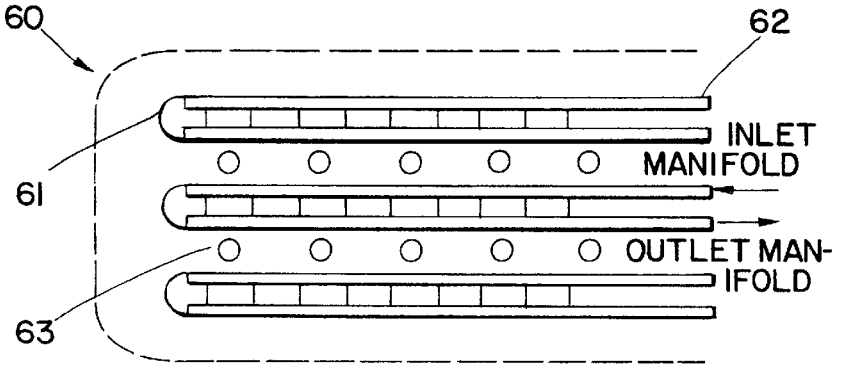
Figure 4B:
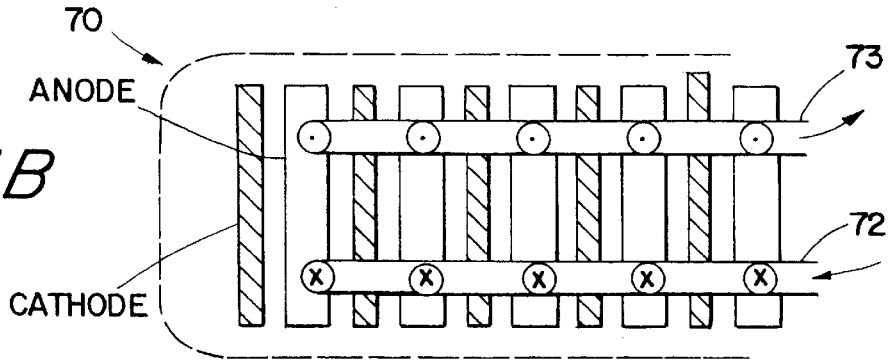

U.S. Pat. No. 5,279,715 to LaCamera et al. (hereby incorporated by reference 5) which described cryolite additions to accomplish a significant lowering of the operational temperature for the HHC also disclosed a novel arrangement of alternating vertically-oriented NCAs and inert cathodes immersed in the molten electrolyte of the HHC. This novel arrangement permitted the active electrolysis area to exceed that of the Al pad, and by variation of the immersion depth, the $I^2R$ heating of the cell could be controlled to maintain a desired cell temperature. FIG. 4 shows a schematic illustration of such a cell, whereby however either planar or tubular SOFC-type NCAs of the present invention have been substituted for the metal/oxide-type NCAs. This arrangement has the same advantages for increasing the cell current density as described by LaCamera et al., with the additional improvement inherent to burning a fuel in the anodic reaction of the present invention. Furthermore, in the arrangements of FIG. 4, only zirconia-covered surfaces of the NCA contact the aggressive cryolite electrolyte. But the introduction of a ceria-base coating over the zirconia should reduce the dissolution attack.

FIG. 4 shows electrode arrangement 50 extending into cryolite bath 51 (supplied with a feed of $Al_2O_3$) over aluminum pad 52. Electrode arrangement 50 comprises a series of SOFC-type anodes 53 which are provided with a fuel gas by fuel inlet 54, and which are exhausted of product gas by product gas outlet 55. The electrode is also provided with an interlaced series of inert cathodes 56 which extend through the cryolite bath 51 into aluminum pad 52. The SOFC-type anodes 53 are separated from the inert cathodes 56 by inert spacers 57. Current from the electrochemical reaction is collected by anode collector bar 58.

FIG. 4 also includes top view (A) of the arrangement 60 of FIG. 4 as it may appear in the case where tubular anodes are used. Top view (A) shows a plurality of tubular anodes 61 each supplied with fuel gas inlet and product gas outlet manifolds 62. Also shown in top view (A) are inert cathodes 63.

FIG. 4 also includes top view (B) of the arrangement 70 of FIG. 4 as it may appear in the case where planar anodes are used. Top view (B) shows a plurality of planar anodes 71 supplied with common fuel gas inlet 72 and product gas outlet manifolds 73. Also shown in top view (A) are inert planar cathodes 74.

Factors Involved With The Use Of Solid Electrolytes As Part Of A Non-Consumable Anode For The HH Cell

Oxide Solubility in Cryolite-based fused salt

Materials problems may arise because the cryolite electrolyte is very aggressive, and HHC operational changes (adjustments in cell temperature, bath composition, etc.) may be required. But if these problems can be solved, the used of a NCA to burn a fuel in the HHC is much simpler than the development of an entire fuel cell (already achieved), which has a multitude of other more serious problems than the functioning of the anode. Besides, solid oxide fuel cells have service lives on the order of 5 years; considering that the current carbon anodes for the HHC are changed every couple weeks, a NCA with a duty cycle of several months, with refurbishable electrode/electrolyte materials, should prove to be economical.

Figure 5:
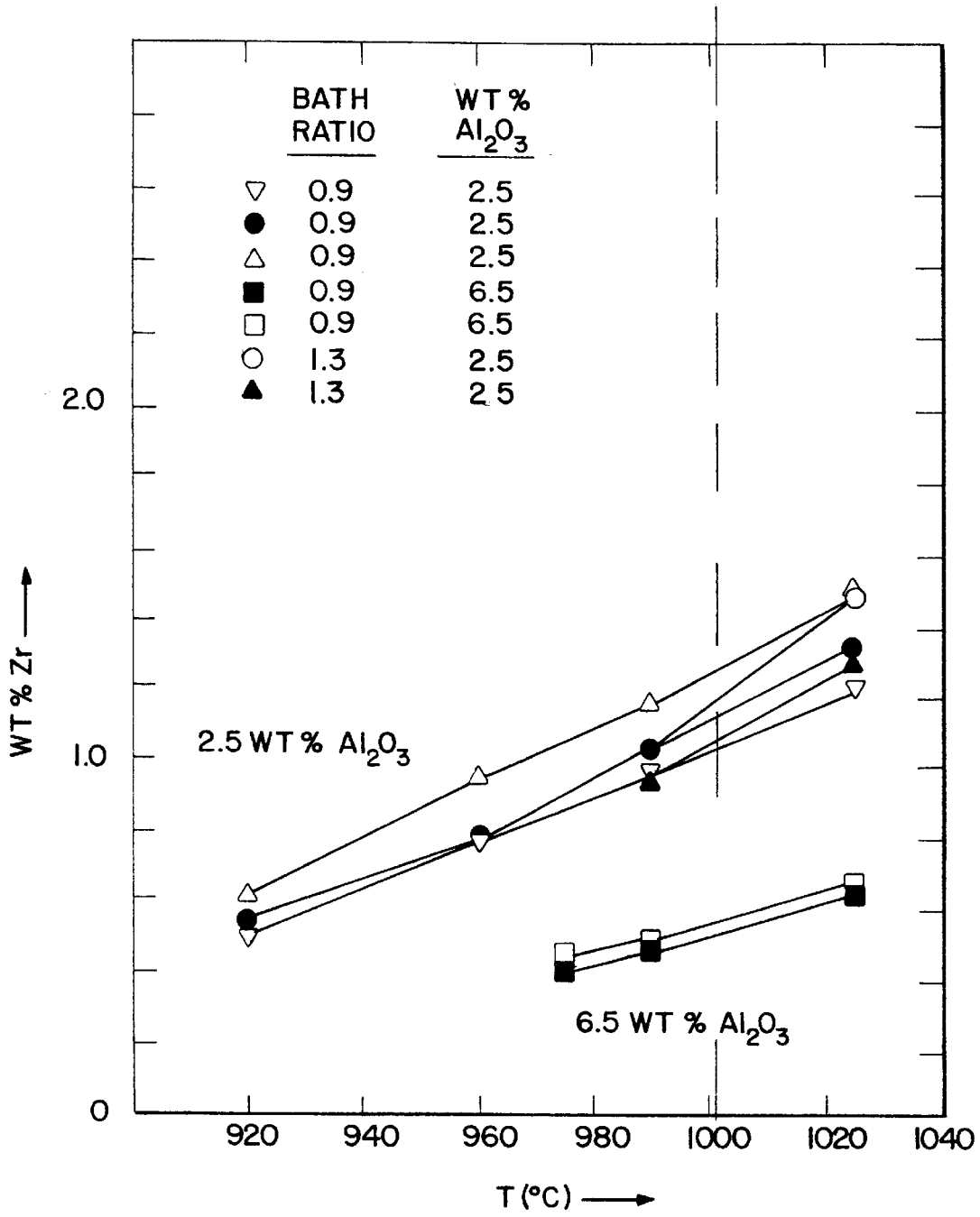
FIG. 5 shows a plot of measurements for $ZrO_2$ solubility in a cryolite-base fused salt.

FIG. 5 shows a plot of measurements (7) for $ZrO_2$ solubility in a cryolite-base fused salt. At the usual HHC temperature of 960 C., the $ZrO_2$ solubility is on the order of a half wt % Zr, independent of the bath ratio, but very dependent on temperature and dissolved $Al_2O_3$ content. This dissolution reaction could be described approximately:

$$ZrO_2+\tfrac{4}{3}AlF_3=ZrF_4+\tfrac{2}{3}Al_2O_3 K_{1200K}=2.1\times10^{-4}$$

For the dissolution of $Y_2O_3$:

$$\tfrac{1}{2}Y_2O_3+AlF_3=YF_3+\tfrac{1}{2}Al_2O_3 K_{1200K}=1.3\times10^{5}$$

so the usual $Y_2O_3$ stabilizer would probably be preferentially leached from YSZ, but other stabilizing elements (such as CaO and MgO) are available. In these cases:

$$CaO+\tfrac{2}{3}AlF_3=CaF_2+\tfrac{1}{3}Al_2O_3 K_{1200K}=1.5\times10^{6}$$

$$MgO+\tfrac{2}{3}AlF_3=MgF_2+\tfrac{1}{3}Al_2O_3 K_{1200K}=2.4\times10^{3}$$

According to these values, the MgO stabilizer, or even CaO (because $MgF_2$ or $CaF_2$ additions are often made to cryolite anyway), would be preferred to $Y_2O_3$. Unfortunately, these stabilizers provide a lower ionic conductivity than the $Y_2O_3$-stabilized solid solution.

The most important aspect of FIG. 5 is the promise offered by consideration of lowering the fused salt temperature significantly, e.g. (off-scale) to lower than about 850° C. Many patents and papers have suggested that the HHC can be run at much lower temperature, e.g. refs. 5 and 9. The negative aspects in lowering the temperature are some decrease in the solubility of alumina in the fused salt, and some lowering of the ionic conductivities for the cryolite-base fused salt and for the zirconia-base solid electrolyte.

Otherwise, a zirconia-based electrolyte might be shielded from dissolution by a dense oxygen-ion conducting coating with a lower solubility, e.g. a $CeO_2$-base electrolyte:

$$CeO_2+\tfrac{4}{3}AlF_3=CeF_4+\tfrac{1}{2}Al_2O_3 K_{1200K}=1.0\times10^{-4}$$

which value is somewhat more favorable than that for zirconia. Although $CeO_2$-base electrolytes have a higher oxygen ion conductivity, they also exhibit significant n-type electronic conductivity, so they should not be used in lieu of $ZrO_2$-base electrolytes. Because of their high partial conductibilities, the $CeO_2$-base coating would not add much IR drop to the cell voltage. Relative to the comparable thermodynamic stabilities for $ZrO_2$ and $CeO_2$ at 1200K, their respective standard Gibbs energies of formation are −208.7 and −199.9 kcal/mol, so the solute of ceria is more likely to be reduced into the Al pad than is the solute of zirconia. Based on this consideration, a lowering of bath temperature, the retention of high dissolved alumina content, and the use of bath additions to reduce zirconia dissolution/reduction may be more favorable than the use of a $CeO_2$-base coating.

Partial Electronic Conductivity Contributions

Figure 6:
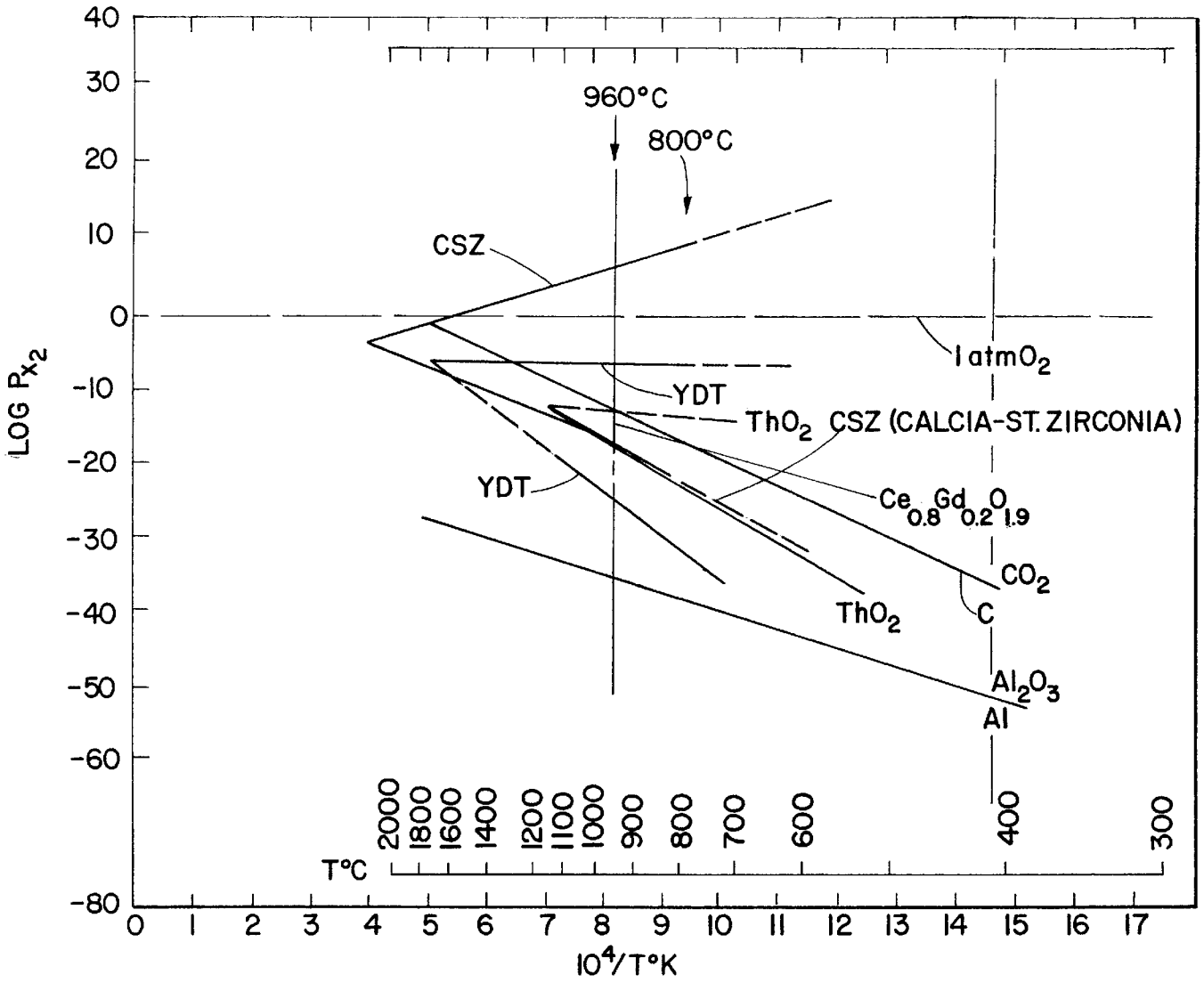
FIG. 6 is a graph of Patterson's plot for the limits on the electrolytic domain for a number of electrolytes.
Figure 1:
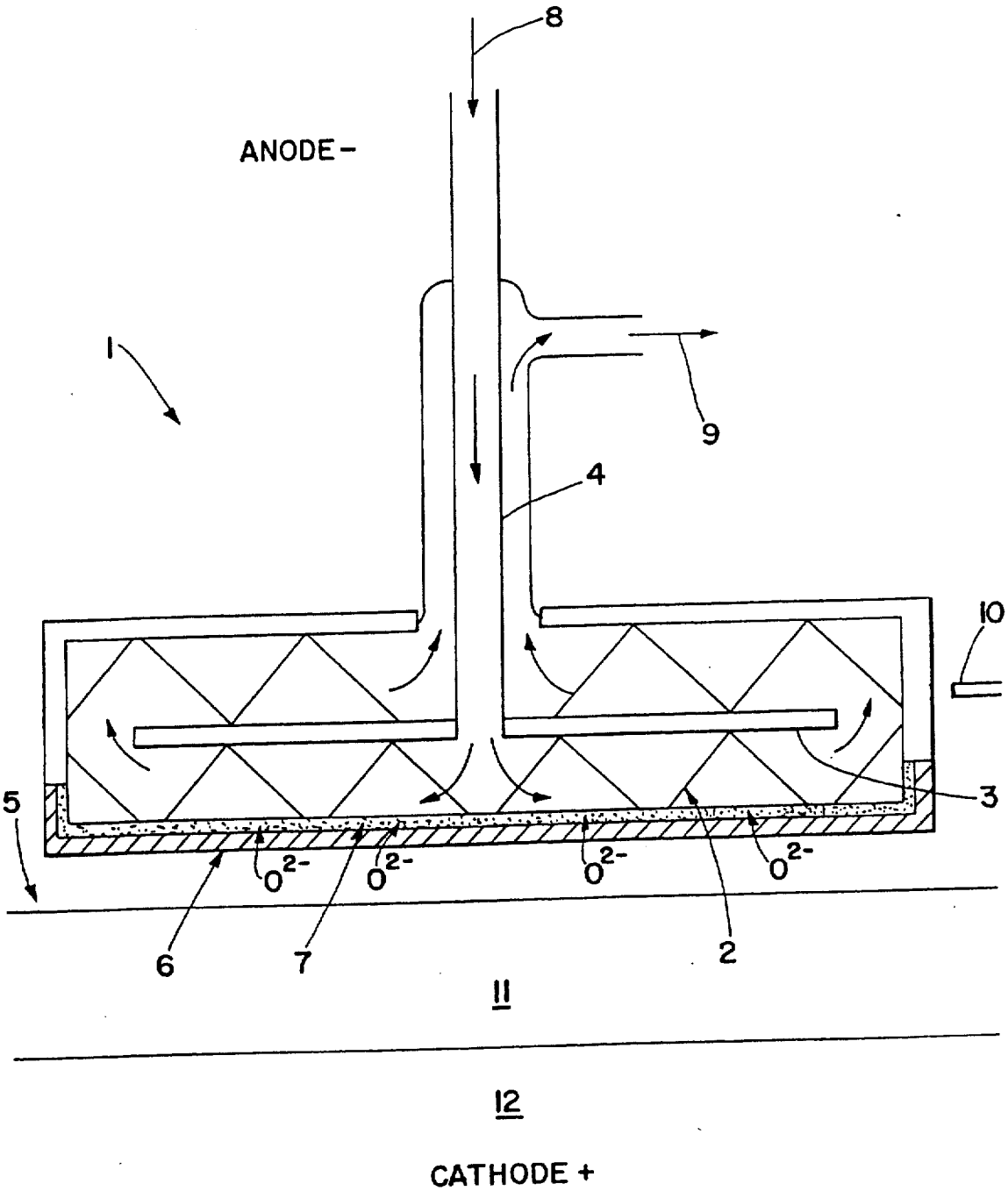
Figure 4:
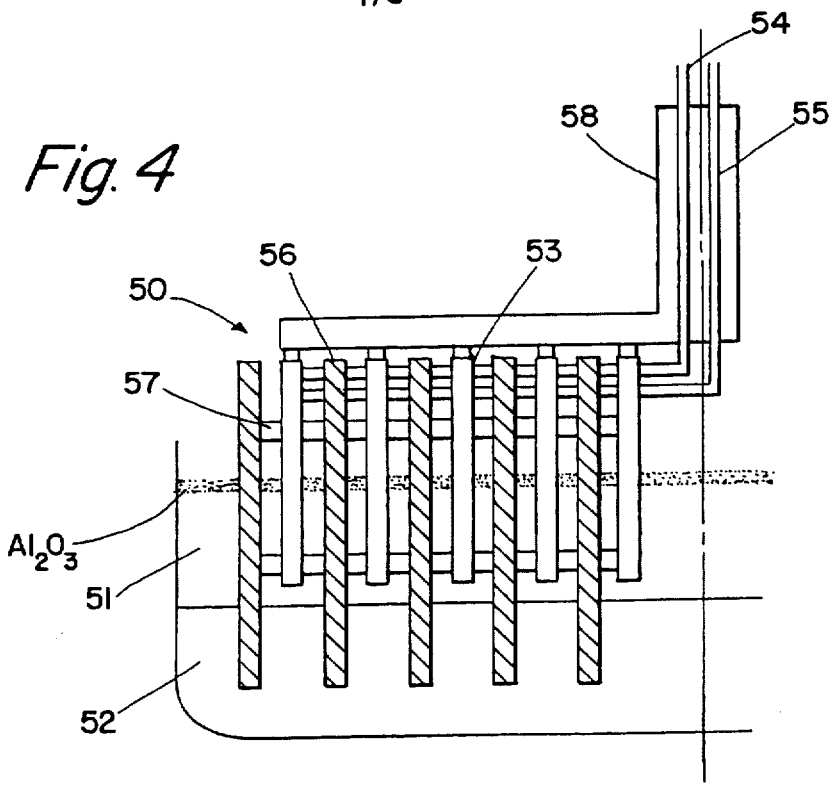
Figure 4A:
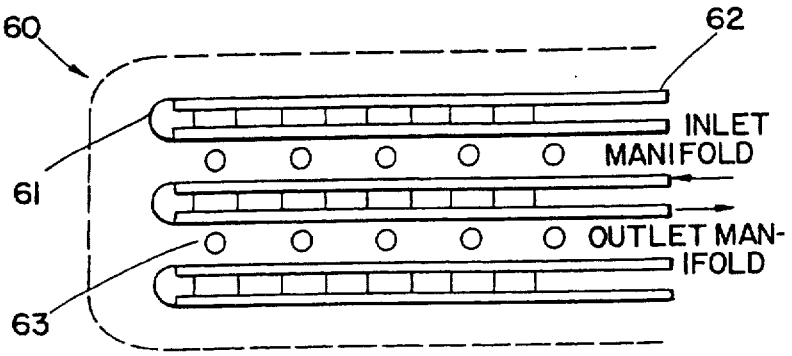
Figure 4B:
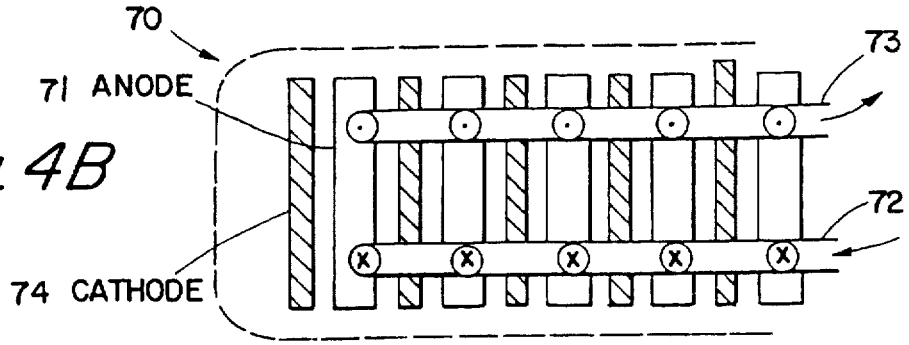

Because the zirconia-base electrolyte will be used over a range of relatively low oxygen activity, one should inquire about the likelihood of inducing significant n-type partial electronic conduction into the solid electrolyte. The data available for mixed conduction by oxygen-conducting electrolytes was treated by Patterson in 1971, and needs to be updated. FIG. 6 provides Patterson's plot for the limits on the electrolytic domain (ionic transference number equal to 0.99) for a number of electrolytes, including CaO-stabilized $ZrO_2$ and $Gd_2O_3$-stabilized $CeO_2$. Two lines of thermodynamic importance have been added: a line for equilibrium between $C/CO/CO_2$ and another for $Al/Al_2O_3$ equilibrium. These latter two lines approximate the possible extreme limits for the use of a zirconia-base electrolyte in the intended application. As long as the soluble oxygen content in the cryolite is kept high, so that the electrolyte service can be held closer to the carbon line and far from the Al line, excessive electronic conduction will be avoided.

Other Considerations

Relative to the thermal shock resistance for the thin, dense ceramic electrolyte, different choices for the stabilizing addition, its concentration, and layer thickness can provide differing mechanical properties (to be balanced by a trade-off in electrical conductance and solubility contributions). Some further experimentation must decide the optimum choices. A number of physical and chemical vapor deposition methods are presently available for forming the thin electrolyte layers. It must be expected that the electrolyte layers can be refurbished after some significant service cycle, so that many such cycles will minimize the cost of the new NCA arrangement. The exchange of the spent anode with a refurbished anode after each duty cycle will present a much easier task, with much less thermal upset, than for the current prebaked carbon anodes.

Industrial Applicability

Cost of Natural Gas Usage vs. Carbon Anode

Currently, the cost to industry for the production of the consumable carbon anodes is about 14.4% of the cost of Al production. (2) For both 1989 and for January 1993, the total cost to produce Al was \$0.622/#Al, so that the cost of the carbon anodes (2–4) would be about \$0.09/#Al. Let us consider the use of natural gas (methane for simplification) to reduce $Al_2O_3$, in combination with an impressed cell voltage. The composition of natural gas is variable, but in the United States, it typically contains 95% $CH_4$ with the balance comprising some higher hydrocarbons. The $CH_4$ would be reformed (internally) into CO and $H_2O$ before passing internally over the SOFC-type Ni anode; in part, the reforming of the fuel s achieved by the reaction of $CH_4$ with some recycled product gas. The stoichiometry of the previous Eq. (5) and the cost for methane needed for the chemical reaction of alumina is considered, while acknowledging that significant electrical energy must still be spent in the electrolysis step.

The price for a very large user of natural gas (NG) (in southern Ohio) on an annual average, including taxes and transportation, would be about $\$3.75/10^3$ SCF (standard cubic feet). For 100% efficiency in the combustion of natural gas to reduce alumina, the cost would be:

$$\text{cost NG/\#Al}=\$3.75/10^3\times(3\times359\ \text{SCF}/8\times27\ \text{\#Al})=\$0.0187/\text{\#Al}.$$

The presence of higher hydrocarbons than $CH_4$ in the NG will lower this value, but some cell inefficiency/incomplete usage would raise it. So the cost of the clean natural gas needed to replace the combustion of dirty carbon anodes should be about \$0.02/#Al, while the cost of the carbon anode is about \$0.09/#Al. Again, from an environmental standpoint, today's smelting practice with carbon anodes releases about 1.65 #CO2/#Al, as well as HF, CO, VOC's and perfluocarbons in the cell, and much more pollution (with energy consumption) in fabrication of the anode. (4) According to Eq. (5), the electrochemical oxidation of pure methane would release 0.56#$CO_2$/#Al, and no other objectionable gases, nor involve much energy consumption in fuel preparation/delivery. Both the significant cost and energy to produce the carbon anodes, and the associated pollution, would be avoided upon using the SOFC-type anode.

Usage/Cost of Electrical Energy in Electrolysis

Let us consider what impact the SOFC-type anode would have on the amount and cost of electrical energy required to run a revised HH cell, i.e., the electrolysis energy which is required in addition to the NG combustion. This is best done by breaking the total cell voltage in its component parts for various versions of the cell. Appendix C in reference (2) provides most of the values required to evaluate various cell options. For the conventional HHC with a consumable carbon anode, the anode to cathode distance (ACD) of about 5 cm introduces about a 1.45 volt drop in the electrolyte, so the IR drop in the cryolite amounts to about 0.3 volt/cm. Then for the existing HHC with a consumable carbon anode:

| | |
|---|---|
| Thermodynamic (open-circuit) voltage | 1.20 volts |
| IR drop in cryolite electrolyte (ACD = 5 cm) | 1.45 |
| Anode overvoltage at carbon surface | 0.50 |
| Voltage drop in anode | 0.35 |
| Voltage drop in cathode | 0.30 |
| Bubble effect | 0.30 |
| Collector bars and externals | 0.30 |
| Total, conventional HHC | 4.40 volts |

Suppose that a cermet inert anode ($NiFe_2O_4$+Cu) could be used to bubble off pure $O_2$ (without any inert cathode), and that the voltage drop in the cathode could be reduced by the use of a protective (sodium-resistant) cathode coating, then the anode-Al cathode spacing to an aluminum pad might be 3.5 cm:

| | |
|---|---|
| Thermodynamic (open-circuit) voltage | 2.20 volts |
| IR drop in cryolite electrolyte (ACD = 3.5 cm) | 1.00 |
| Anode overvoltage at carbon surface | 0.10 |
| Voltage drop in anode | 0.20 |
| Voltage drop in cathode | 0.25 |
| Bubble effect | 0.00 |
| Collector bars and externals | 0.30 |
| Total, inert anode & A1 pad | 4.05 volts |

If an inert cathode projecting above the Al pad could be used in combination with the inert anode, then the ACD could be reduced to about 2 cm, reducing the voltage drop in the electrolyte to 0.065 volts, for a total voltage, using "conventional" inert anode and inert cathode, of 3.70 volts. Other terms in the preceding table would remain the same.

Likewise, if both typical inert anodes and inert cathodes were arranged in an interleaved vertical arrangement as described in the La Camera patent, the anode-cathode pacing could be reduced to the equivalent of 1 cm. Then the voltage drop in the electrolyte should amount to only about 0.3 volts and total cell voltage to 3.35 volts.

Note that none of the latter three scenarios, which would reduce the electrical cost for electrolysis (currently, \$0.149/#Al for 4.40 cell voltage) by \$0.012/#Al, \$0.024/#AR, and 0.036/#AR, respectively, is an engineering reality today. Without a drastic change in cell design and operating procedures, the typical inert anode introduces too much Ni and Fe impurities into the Al produced. A satisfactory inert cathode has not yet been developed. Besides, any inert anode and cathode would also cost money and energy for their fabrication.

Let us now estimate the voltage drops for a new cell which would incorporate a SOFC-type NCA, with various other conditions for its use. The current SOFC generates one volt at open-circuit for the combustion of reformed natural gas fuel versus air, so the thermodynamic open-circuit voltage for the use of such an SOFC-type anode in a HH cell is about the same as for today's HHC involving a carbon anode. But the IR voltage drop across the solid electrolyte (in electrical series with the cryolite) would depend upon the choice of the solid electrolyte, its thickness, and the temperature. So for the use of an SOFC-type anode, according to the present invention, without the benefit of an inert cathode (over an Al pad):

| | |
|---|---|
| Thermodynamic (open-circuit) voltage | 1.20 volt |
| IR drop in cryolite (ACD =2 cm over A1 pad) | 0.65 |
| IR drop in solid electrolyte (variable possibilities) | 0.20 to 0.40 |
| Anode overvoltage | 0.02 |
| Voltage drop in anode | 0.20 |
| Voltage drop in cathode | 0.25 |
| Bubble effect | 0.00 |
| Collector bars and externals | 0.30 |
| Total, SOFC-type anode with A1 pad | 2.82 to 3.02 volts |

In combination with a yet-unavailable inert cathode, the ACD could also be dropped to about 1 cm. So for the use of the SOFC-type anode, in combination with an inert cathode, in either the "conventional" horizontal or the alternative vertical arrangement:

| | |
|---|---|
| Thermodynamic (open-circuit) voltage | 1.20 volt |
| IR drop in cryolite (1 cm ACD) | 0.30 |
| IR drop in solid electrolyte (variable possibilities) | 0.20 to 0.40 |
| Anode overvoltage | 0.02 |
| Voltage drop in anode, cathode, bars and extern. | 0.75 |
| Total, SOFC-type anode with inert cathode | 2.47 to 2.67 volts |

These two modifications of the SOFC-type anode (for the average estimated values used here, 2.92 and 2.57 volts, respectively) promise savings in electrical cost for electrolysis of \$0.050/#Al and \$0.064/#Al, respectively. These potential savings are very substantial in light of the current \$0.73/#Al selling price for Al. As mentioned, the IR drop for the zirconia-base electrolyte would depend upon the choice of the stabilizing oxide (e.g. $Y_2O_3$, CaO, or MgO), the electrolyte thickness, and the cell temperature. The interaction of all these variables with the chosen cryolite-base melt composition (and the cost of anode fabrication) would be considered to decide the intended campaign life of the SOFC-type anode between refurbishments. The calculations presented for the electrical cost of Al production using a SOFC-type anode burning reformed natural gas suggest that a quite thick solid electrolyte layer could be used (to extend the campaign life) compared to the usual 20–40$\mu$m thickness used for fuel cells. The associated increase in IR drop would not drastically impact the cell voltage or electrical cost for Al production.

Relative to the ACD for the SOFC-type anode, for any chosen solid electrolyte, these materials are, by definition, not significant electronic conductors, unless they are drastically reduced in the service environment. Thus, the incidental contact of the solid electrolyte with the Al pad should not constitute an electrical short, nor result in any exceptional chemical attack. Then the SOFC-type anode can be placed quite close to some inert cathode (when available) without the usual problems experienced for current carbon anodes, or for the prospective inert anode, where shorting could lead to a violent reaction. As another unique and favorable aspect for the SOFC-type anode, there can be no "anode effect" of the sort experienced by the current HHC. Should the melt electrolyte become extremely low in dissolved alumina content, the external surface for the solid electrolyte would tend to become reduced, and its partial electronic conduction would increase. But this circumstance would not occur with proper alumina supply, nor would it promise any catastrophic consequence.

While ceria-base solid electrolytes have a higher ionic conductivity than zirconia-base electrolytes, and although ceria has a lower solubility in cryolite-base melts than zirconia, the ceria-base electrolytes also exhibit a significant n-type partial electronic conductivity in the reducing conditions pertinent to this application. So a ceria-base electrolyte would not offer the same promise of lowering the applied voltage as the family of zirconia-base electrolytes. On the other hand, a thin layer of a mixed conducting ceria-base electrolyte could be deposited on top of the zirconia-base electrolyte to minimize the corrosive interaction with the cryolite melt, while offering little additional contribution to the IR drop. However, the thermodynamic stability of $CeO_2$is lower than that for $ZrO_2$, so any solute of ceria is more likely to be reduced into the Al pad than is a solute of zirconia.

Summary and Perspective

The SOFC-type anodes, retrofitted into existing HH cells in such arrangements as illustrated in FIGS. 1–4 offer significant promise for the production of primary Al. The projected reductions in materials cost, electrical cost, and environmental emissions would individually and certainly collectively, justify the development of such a technology. The broader concept applied here involves the direct substitution of chemical energy at the site of energy use; such a substitution must be inherently favorable from both economic and environmental viewpoints. Currently, especially for environmental reasons, an increasing fraction of the electrical energy produced in U.S. power plants is derived by the combustion of natural gas, using gas turbines and related expensive equipment. The efficiency of energy conversion may reach 45%. While the Al industry depends more on electrical power provided by hydroelectric and coal-burning power plants, the combustion of natural gas is competitive, and certainly preferred environmentally. Accordingly, to provide power to a primary Al facility, the electric utility may charge a profit, and the power is transported and transformed from AC to DC, each involving losses, equipment, and costs. In comparison, the on-site (i.e., within anode) utilization of the reformed natural gas should occur with about 80% or better efficiency, and the intermediate profit, costs and pollution for power production, transport and conversion are eliminated. In effect, both the chemistry and energy values of the fuel can be used to advantage. While the SOFC-type anode still evolves some greenhouse $CO_2$, the amount is only about half that which would have been generated at a power plant burning natural gas to effect the same energy input for today's HHC.

The major technical problem facing the substitution of the SOFC-type anode will be the dissolution of the electrolyte, which must be limited by clever choices and compromises for materials and control of the cryolite-melt composition and temperature, and cell geometry, while not reducing the alumina solubility too much. A protective coating of a zirconia-base electrolyte with a mixed conducting ceria-base material could be useful.

The present invention thus addresses what The Aluminum Technology Roadmap Workshop of November 1996 identified as the most critical need, that being "alternative reduction and refining processes, including entirely new ideas for producing aluminum."

The following references, in their entirety, are hereby incorporated herein by reference:

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, it will be within the ability of one of ordinary skill in the art to make alterations or modifications to the present invention, such as through the substitution of equivalent materials or structural arrangements, so as to be able to practice the present invention without departing from its spirit as reflected in the appended claims. It is the intention, therefore, to limit the invention only as indicated by the scope of the claims.

What is claimed is:

1. A method of producing aluminum metal into a molten aluminum bath from alumina through the use of an electrochemically combustible fuel and an electric current, said method comprising electrochemically combusting said electrochemically combustible fuel with oxygen ions from said alumina so as to produce a flow of oxygen ions from said alumina while causing said electric current to flow from said molten aluminum bath, so as to produce aluminum from said alumina.

2. A method according to claim 1 wherein said electrochemically combustible fuel comprises reformed natural gas.

* * * * *

UNITED STATES PATENT AND TRADEMARK OFFICE

CERTIFICATE OF CORRECTION

PATENT : 6,039,862

DATED : March 21, 2000

INVENTOR(S) : Rapp

It is certified that error appears in the above-identified patent and that said Letters Patent is hereby corrected as shown below:

In column 2, line 65, please delete the word "that" and replace it with the word -- than --;

In column 7, line 49, please delete the word "magnesis" and replace it with the word -- magnesia -- ;

In column 9, line 22, please delete the word "closed" and replace it with the word -- open --;

In the Drawings:

In the drawings, replacement pages are herewith submitted for Fig.1 and Fig. 4, 4A, and 4B to correct omissions or errors.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*